US006746311B1

(12) United States Patent
Kessel

(10) Patent No.: US 6,746,311 B1
(45) Date of Patent: Jun. 8, 2004

(54) POLISHING PAD WITH RELEASE LAYER

(75) Inventor: Carl R. Kessel, St. Paul, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 0 days.

(21) Appl. No.: 09/490,646

(22) Filed: Jan. 24, 2000

(51) Int. Cl.[7] ..... B23F 21/03

(52) U.S. Cl. ..... 451/41; 451/552; 451/533; 51/293; 51/297

(58) Field of Search ..... 451/41, 533, 552, 451/534, 530; 51/293, 257, 297, 294, 295, 296; 428/143, 331, 932, 447

(56) References Cited

U.S. PATENT DOCUMENTS

| | | | | | |
|---|---|---|---|---|---|
| 3,499,250 | A | * | 3/1970 | Jensen et al. | 428/316.6 |
| 3,504,457 | A | * | 4/1970 | Jacobsen et al. | 451/288 |
| 3,863,395 | A | * | 2/1975 | Brown | 451/272 |
| 4,343,910 | A | | 8/1982 | Busch, Jr. et al. | 521/82 |
| 4,527,358 | A | | 7/1985 | Day | 51/131.3 |
| 4,667,447 | A | * | 5/1987 | Barton | 15/230 |
| 4,879,258 | A | * | 11/1989 | Fisher | 438/5 |
| 5,015,266 | A | * | 5/1991 | Yamamoto | 51/293 |
| 5,020,283 | A | * | 6/1991 | Tuttle | 451/527 |
| 5,383,309 | A | | 1/1995 | Sampietro | 451/533 |
| 5,453,312 | A | * | 9/1995 | Haas et al. | 428/143 |
| 5,505,747 | A | | 4/1996 | Chesley et al. | |
| 5,507,464 | A | | 4/1996 | Hamerski et al. | 248/683 |
| 5,551,136 | A | | 9/1996 | Bartlett | 29/239 |
| 5,692,950 | A | | 12/1997 | Rutherford et al. | 451/552 |
| 5,921,514 | A | | 7/1999 | Schumann | 248/205.3 |
| 5,931,724 | A | | 8/1999 | Perlov et al. | 451/285 |
| 5,958,794 | A | | 9/1999 | Bruxvoort et al. | 438/692 |
| 6,036,586 | A | | 3/2000 | Ward | 451/287 |

FOREIGN PATENT DOCUMENTS

| | | | |
|---|---|---|---|
| EP | 0 418 093 A2 | 3/1991 | |
| EP | 0 850 726 | 7/1998 | B24B/37/04 |
| JP | 11-151661 | 6/1999 | B24B/37/00 |
| WO | WO 98/49723 | 11/1998 | H01L/21/321 |
| WO | WO 99/07518 | 2/1999 | |
| WO | WO 99/24218 | 5/1999 | B24B/1/00 |
| WO | WO 99/31193 | 6/1999 | |

* cited by examiner

*Primary Examiner*—Joseph J. Hail, III
*Assistant Examiner*—Anthony Ojini
(74) *Attorney, Agent, or Firm*—Gary L. Griswold; Dean M. Harts; Colene E. H. Blank

(57) ABSTRACT

A multi-layered polishing pad for modifying a surface of a workpiece, such as a semiconductor wafer, that reduces the effort, time and cost involved with pad replacement. The polishing pad includes a polishing layer, at least one sub-pad layer adjacent the polishing layer, and an attachment layer interposed between and releasably joining the polishing layer and at least a portion of the at least one sub-pad layer. The at least one sub-pad layer may include a plurality of layers, such as at least one resilient layer, at least one rigid layer, and/or at least one layer that has both rigid and resilient characteristics. The release layer may be interposed between the polishing layer and the sub-pad or between adjacent layers of the sub-pad. Multiple release layers may be included that are interposed between the polishing layer and layers of the sub-pad, as desired. When the polishing layer and/or other sub-pad layers wear out and need to be replaced, the worn layers may be removed from the polishing pad at one or more release layers, leaving the non-worn layers of the sub-pad still attached to a polishing device. A new polishing layer with or without attached sub-pad layers may then be attached to the remaining sub-pad layers on the polishing device for continued polishing processes.

34 Claims, 3 Drawing Sheets

POLISHING PAD WITH RELEASE LAYER

FIELD OF THE INVENTION

This invention relates to a multi-layered polishing pad having separable layers for modifying an exposed surface of a semiconductor wafer.

BACKGROUND OF THE INVENTION

In the course of integrated circuit manufacture, a semiconductor wafer typically undergoes numerous processing steps, including deposition, patterning, and etching steps. After selected steps in this process, it is often desirable, and often necessary, to periodically modify or planarize the wafer surface to achieve a pre-determined level of surface "planarity" and/or "uniformity".

Chemical mechanical polishing (CMP) is a known method of planarizing the surface of a semiconductor wafer. In CMP planarization, a semiconductor wafer is typically mounted on a carrier or polishing head. The exposed surface of the wafer is then placed against a rotating polishing pad in the presence of polishing slurries or fluids. Suitable polishing pads include slurry pads for use with polishing slurries as well as fixed abrasive pads for use with polishing fluids.

During CMP planarization, the polishing pads are periodically replaced. For a fixed abrasive pad, the wafer wears away the abrasive contact surface of the pad. Thus, the fixed abrasive surface is gradually worn away or used up by the polishing process and, after a sufficient number of wafers have been polished, the fixed abrasive pad must be replaced. For a slurry pad, the wafer both mechanically and thermally damages the contacting surface of the polishing pad and causes the surface to become smoother and less effective. Therefore, slurry pads must regularly be "conditioned" to restore a roughened texture to the contacting surface and when such conditioning can no longer be done, these pads must also be replaced.

These polishing pads typically are constructed as a multi-layered stack of materials that are chosen in order to provide a good planarization of the features on the semiconductor wafer. The portion of the stack attached to the polishing surface is known as the "sub-pad". These sub-pads may be as simple as foam layered with adhesive, or may be complex layerings of rigid and resilient materials, adhesives, film carriers and/or other materials. In general, the cost of the sub-pad tends to represent a large portion of the overall cost of the polishing pad.

When the polishing surface of the pad wears out and is no longer usable, the polishing pad must be replaced, which typically entails removal of the entire pad from the polishing machine. Since polishing pads are typically adhered directly to the aluminum or stainless steel platen of the polishing machine, removal from the platen is often time consuming and difficult. In addition, since the abrasive polishing surface of the pad usually wears out faster than the sub-pad layers, replacement of the whole polishing pad under these circumstances is more expensive than necessary.

SUMMARY OF THE INVENTION

The present invention provides a polishing pad suitable for semiconductor wafer planarization that reduces the effort, time and cost involved with pad replacement. The polishing pad includes a sub-pad having at least one layer and a polishing surface. At least one release layer is interposed between the polishing surface and at least some portion of the sub-pad. When the polishing surface of the pad becomes unusable, the surface may easily be removed at a release layer leaving at least a portion of the sub-pad still attached to the polishing device to which the polishing pad is mounted during a polishing process. A new polishing surface may then be attached to the remaining portion of the sub-pad. Release layers may be interposed between different layers of a multi-layer sub-pad, if desired. Thus, only the portions of the polishing pad that require replacement are removed, thereby simplifying and reducing the cost of polishing pad replacement.

Throughout this application, the following definitions apply:

"Surface modification" refers to wafer surface treatment processes, such as polishing and planarizing;

"Rigid element" refers to an element which is of higher modulus than the resilient element and which deforms in flexure;

"Resilient element" refers to an element which supports the rigid element, elastically deforming in compression;

"Modulus" refers to the elastic modulus or Young's Modulus of a material; for a resilient material it is measured using a dynamic compressive test in the thickness direction of the material, whereas for a rigid material it is measured using a static tension test in the plane of the material;

"Fixed abrasive element" refers to an integral abrasive element, such as an abrasive article, that is substantially free of unattached abrasive particles except as may be generated during modification of the surface of the workpiece (e.g., planarization);

"Three-dimensional" when used to describe a fixed abrasive element refers to a fixed abrasive element, particularly a fixed abrasive article, having numerous abrasive particles extending throughout at least a portion of its thickness such that removing some of the particles at the surface during planarization exposes additional abrasive particles capable of performing the planarization function;

"Textured" when used to describe a fixed abrasive element refers to a fixed abrasive element, particularly a fixed abrasive article, having raised portions and recessed portions in which at least the raised portions contain abrasive particles and binder;

"Abrasive composite" refers to one of a plurality of shaped bodies which collectively provide a textured, three-dimensional abrasive element comprising abrasive particles and binder; the abrasive particles may be in the form of abrasive agglomerates; and "Precisely shaped abrasive composite" refers to an abrasive composite having a molded shape that is the inverse of the mold cavity which is retained after the composite has been removed from the mold; preferably, the composite is substantially free of abrasive particles protruding beyond the exposed surfaces of the shape before the abrasive article has been used, as described in U.S. Pat. No. 5,152,917 (Pieper et al.).

DETAILED DESCRIPTION OF THE INVENTION

Figure 1:
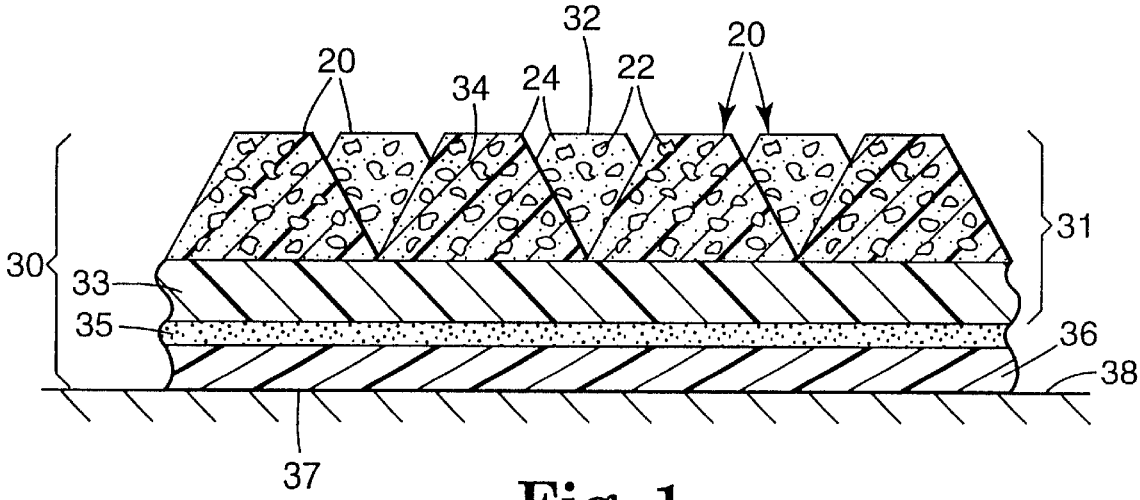
FIG. 1 is a cross-sectional view of a portion of a multi-layered polishing pad including a release layer in accordance with the present invention.

With reference to the attached Figures, it is to be understood that like components are labeled with like numerals throughout the several Figures. A polishing pad for modifying an exposed surface of a workpiece, such as a semiconductor wafer, includes one or more release layers that facilitate pad replacement in accordance with the present invention. As shown in FIG. 1, a polishing pad 30 includes a polishing element 31, which has a surface 32 that contacts the workpiece, such as a fixed abrasive or slurry-type polishing surface, and a sub-pad element 36. The sub-pad element 36 has a surface 37 that attaches the polishing pad 30 to a platen 38, or other surface of a polishing device, during a polishing process. The sub-pad element 36 may be formed from a resilient material, a rigid material, or a material having both properties. Alternately, the sub-pad element 36 may be formed as an assembly of multiple layers having the desired characteristics, including at least one attachment layer, such as an adhesive layer.

Figure 2:
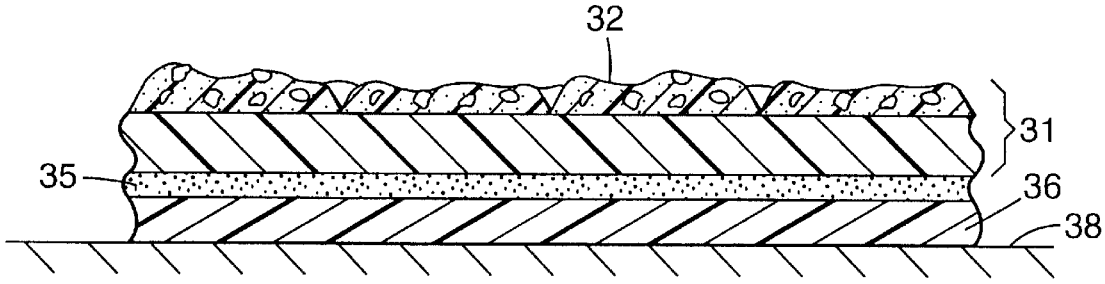
FIG. 2 is a cross-sectional view of a portion of the multi-layered polishing pad of FIG. 1 having a worn polishing surface.
Figure 3:
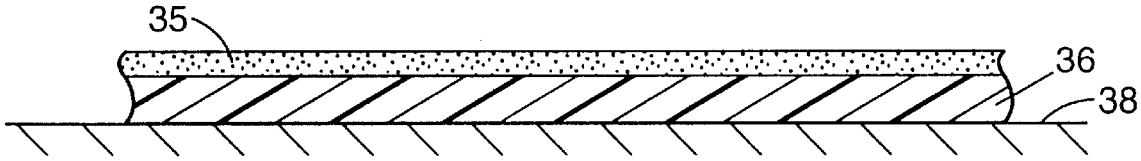
FIG. 3 is a cross-sectional view of a portion of the multi-layered polishing pad of FIGS. 1 and 2, wherein the worn polishing surface has been removed in accordance with the present invention.
Figure 4:
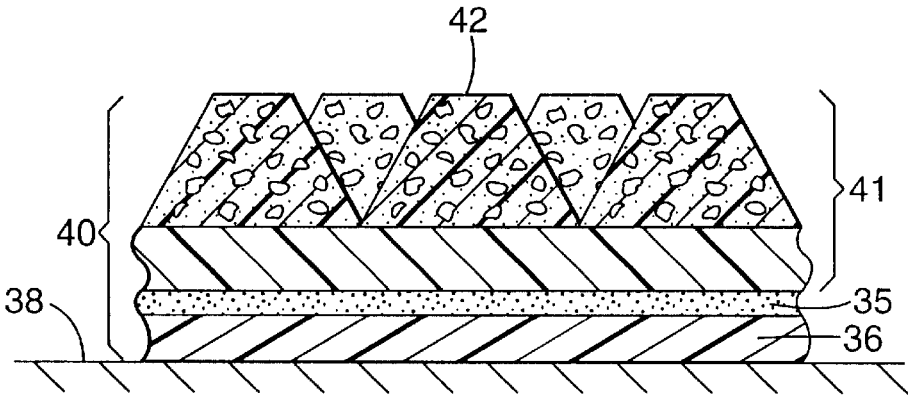
FIG. 4 is a cross-sectional view of a portion of a new multi-layered polishing pad formed by replacing the worn polishing surface of the polishing pad shown in FIGS. 1 and 2 with a new polishing surface in accordance with the present invention.

Referring now also to FIGS. 2–4, interposed between the polishing element 31 and the sub-pad element 36 is a release layer 35 that attaches the polishing element 31 to the sub-pad element 36. During the polishing process, the release layer 35 maintains sufficient adhesion between the polishing element 31 and the sub-pad element 36 to prevent delamination of the polishing element 31 from the sub-pad element 36. When the polishing surface 32 of the polishing element 31 wears out or otherwise becomes unusable (as shown in FIG. 2), the polishing element 31 may be replaced by removing the polishing element 31 from the sub-pad layer 36 at the release layer 35 (as shown in FIG. 3). A new polishing element 41 having an unworn polishing surface 42 is then secured to the sub-pad layer 36 at the release layer 35 creating a new polishing pad 40 (as shown in FIG. 4).

The release layer 35 is preferably formed from a low adhesion backsize material, including but not limited to silicone, fluorosilicone, or fluorochemical materials, coated onto a carrier film, such as polyester, polypropylene, or paper. Examples of materials suitable for use as the release layer 35 include kraft papers, polyethylene, polypropylene, polyester or composites of any of these materials which can be coated with release agents such as fluorochemicals or silicone. U.S. Pat. No. 4,472,480 describes low surface energy perfluorochemical liners. The preferred liners are papers, polyolefin films, or polyester films coated with silicone release materials. Examples of the silicone coated release papers are Polyslik trade silicone release papers supplied by James River Co., H.P. Smith Division (Bedford Park, Ill.), and silicone coated papers supplied by Daubert Chemical Co. (Dixon, Ill.). The release layer 35 may be formed as an assembly that includes a layer of adhesive for attachment to adjacent sub-pad layers or to the platen 38, or other layers of material as desired.

Alternately, the release layer 35 may be formed from a releasable adhesive system, such as a stretch release adhesive. Conventionally known stretch releasing adhesives include a pressure sensitive adhesive tape with an elastic core, a pressure sensitive adhesive tape with a highly extensible and substantially inelastic core, or a solid, elastic pressure sensitive adhesive. Specific tapes suitable for use in the various embodiments of the present invention include the pressure sensitive adhesive tapes with elastic backings described in U.S. Pat. No. 4,024,312 (Korpman), the pressure sensitive adhesive tapes with highly extensible and substantially inelastic backings described in U.S. Pat. No. 5,516,581 (Kreckel et al.) and PCT International Publication No. WO 95/06691 (Bries et al); and the solid, elastic pressure sensitive adhesive described in German Patent No. 33 31 016. In addition, the stretch releasing adhesive tape of the present invention can include a splittable layer such as the layers described in PCT International Publication No. WO 98/21285, or a re-fastenable layer such as the layers described in PCT International Publication No. WO 99/31193.

Optionally, the release layer 35 may be formed from a mechanical attachment device such as a hook and loop type system. The loop fabric may be on the positioned on the polishing element 31 with the hooks located on the sub-pad element 36. Alternately, the hooks may be positioned on the polishing element 31 with the loop fabric located on the sub-pad element 36. A hook and loop type attachment system is further described in U.S. Pat. Nos. 4,609,581, 5,254,194, and 5,505,747 and PCT WO 95/19242, all incorporated herein by reference.

Typically, polishing pads used in semiconductor wafer planarization include a sub-pad that is constructed of numerous layers of material and adhesive. It has been found that substantial conformance of the polishing pad to the global topography of the surface of a workpiece (e.g., the overall surface of a semiconductor wafer) without substantial conformance to the local topography of the surface of the workpiece (e.g., the spacing between adjacent features on the surface of a semiconductor wafer) during surface modification or planarization is desirable. Such dual conformance has been found to occur when a relatively rigid layer is interposed between a resilient layer and the polishing layer in the sub-pad. Preferably, such a polishing sub-pad includes at least one relatively high modulus rigid element and at least one lower modulus resilient element. Suitable sub-pad constructions of this type are disclosed in U.S. Pat. No. 5,692,950 (Rutherford et al.), which is incorporated herein by reference.

Figure 5:
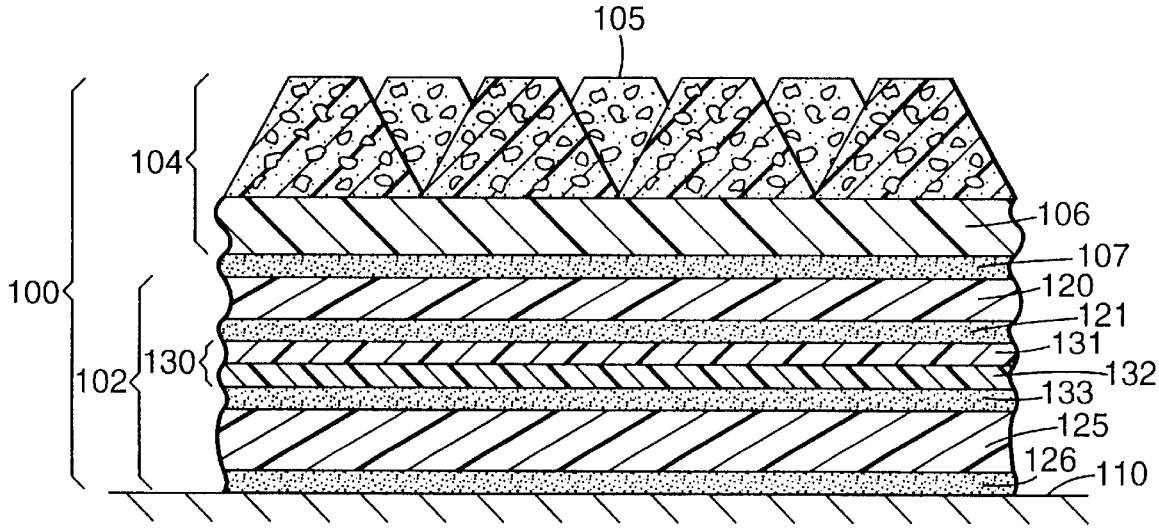
FIG. 5 is a cross-sectional view of a portion of another embodiment of a multi-layered polishing pad including an abrasive layer, a rigid layer, a resilient layer and a release layer interposed between the rigid and resilient layers in accordance with the present invention.

Referring now to FIG. 5, a polishing pad 100 in accordance with the present invention having a multi-layered sub-pad 102 is shown attached to a platen 110 at adhesive layer 126. In this embodiment, the polishing pad 100 includes a three-dimensional, textured, fixed abrasive element 104, which has a surface 105 that contacts the workpiece. The abrasive element 104 includes a carrier layer 106 that attaches to the sub-pad 102 at an adhesive layer 107. The sub-pad 102 includes a relatively rigid element 120 interposed between a resilient element 125 and the abrasive element 104.

The sub-pad 102 also includes a release element 130 interposed between the rigid element 120 and the resilient element 125, attached to the rigid element 120 at adhesive layer 121. In this embodiment, the release element 130 includes a release layer 131, such as a silicone coating, on a carrier film layer 132. The release element 130 attaches to the adjacent resilient element 125 at adhesive layer 133. In this position, the release element 130 allows for removal of the abrasive element 104 and the attached rigid element 120 from the resilient element 125. Replacement of these elements, 104 and 120, without having to remove the resilient element 125 from the platen 110 is thus simplified, thereby reducing the time and overall cost of replacement.

Figure 6:
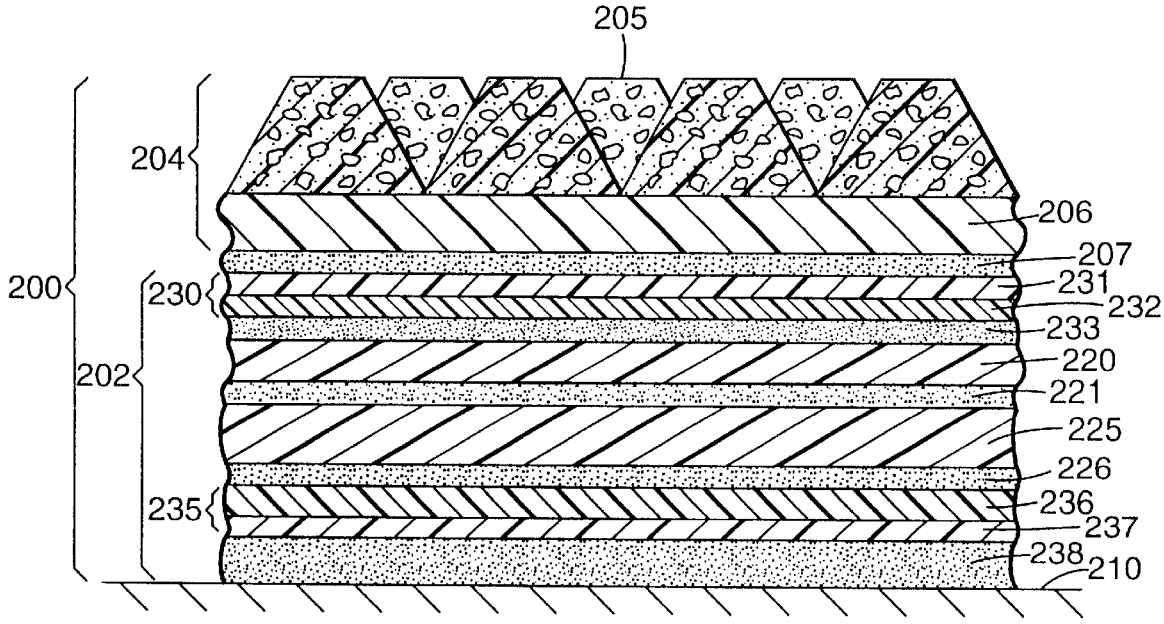
FIG. 6 is a cross-sectional view of a portion of the multi-layered polishing pad shown in FIG. 5 having a release layer interposed between the abrasive and rigid layers and a release layer interposed between the resilient layer and a polishing device platen in accordance with the present invention.

Referring now to FIG. 6, in another embodiment, a polishing pad 200 having a multi-layered sub-pad 202 is shown attached to a platen 210 at adhesive layer 238. The polishing pad 200 includes a three-dimensional, textured, fixed abrasive element 204, which has a surface 205 that contacts the workpiece. The abrasive element 204 includes a carrier layer 206 that attaches to the sub-pad 202 at an adhesive layer 207. The sub-pad 202 includes a relatively rigid element 220 interposed between a resilient element 225 and the abrasive element 204.

The sub-pad 202 also includes multiple release elements: a first release element 230 interposed between the abrasive element 204 and the rigid element 220; and a second release element 235 interposed between the resilient element 225 and the platen 210. In this embodiment, both release elements 230, 235 include a release layer 231, 236, such as a silicone coating, on a carrier film layer 232, 237. The first release element 230 attaches to the adjacent rigid element 220 at adhesive layer 233. In this position, the first release element 230 allows for removal of the abrasive element 204 from the sub-pad 202. Replacement of only the abrasive element 204, without having to remove any of the sub-pad 202 from the platen 210 is thus facilitated, thereby reducing the time and overall cost of polishing pad replacement when only the abrasive surface 205 wears out.

The second release element 235 attaches to the adjacent resilient element 225 at adhesive layer 226, and attaches to the adjacent platen 210 at adhesive layer 238. In this position, the second release element 235 allows for removal of the entire polishing pad 200 from the platen 210, thereby facilitating replacement and change-over of the polishing pad 200 without having to deal with potentially difficult adhesion issues or adhesive residue cleanup from the: platen 210. As a result, the time required for polishing pad change-over is greatly reduced, thereby also reducing the costs.

Although shown as single layers in the above embodiments, it is to be understood that the abrasive, rigid and resilient elements of the sub-pad may be formed from multiple layers of the same or different materials, as required to meet the needs of the polishing application. In addition, the adhesive layers may be formed from multiple layers of the same or different materials, if desired, or may be formed from other means of attachment.

Numerous variations in the location and number of release elements used within a multi-layered sub-pad are possible, and are within the scope and spirit of the present invention. For example in sub-pad 202, a third release element (not shown) may be interposed between the rigid element 220 and the resilient element 225 (similar to release element 130 shown in FIG. 5 for sub-pad 102). Such placement of a release element would also allow for removal of the abrasive element 204 and rigid element 220 sub-combination from the resilient element 225, if desired. The number and position of the release elements used within a sub-pad will depend on the number and types of layers within the multi-layered sub-pad, as well as the intended use and foreseeable replacement requirements of the polishing pad.

Referring again to FIG. 1, in this embodiment, the polishing element 31 is shown with a backing 33 having a surface to which is bonded an abrasive coating 34, which includes a pre-determined pattern of a plurality of precisely shaped abrasive composites 20 comprising abrasive particles 22 dispersed in a binder 24. Abrasive coating 34 may be continuous or discontinuous on the backing. In certain embodiments, however, the fixed abrasive element does not require a backing. Furthermore, a rigid element of the polishing pad could be provided by the backing of the fixed abrasive element, at least in part. Although shown as a textured, three-dimensional, fixed abrasive element having precisely shaped abrasive composites, the abrasive compositions of the present invention are not limited to precisely shaped composites. That is, other textured, three-dimensional, fixed abrasive elements are possible. Suitable abrasive elements and methods for using them in semiconductor wafer processing are disclosed in U.S. Pat. No. 5,958,794 (Bruxvoort et al.), which is incorporated herein by reference.

Although the multi-layered polishing pads of the present invention are particularly suitable for use with processed semiconductor wafers (i.e., patterned semiconductor wafers with circuitry thereon, or blanket, nonpatte med wafers), they can be used polish or planarize unprocessed or blank (e.g., silicon) wafers as well.

The polishing pads of the present invention can be used on many types of machines for planarizing semiconductor wafers, as are well known in the art for use with polishing pads and loose abrasive slurries. An example of a suitable commercially available machine is a Chemical Mechanical Planarization (CMP) machine available from IPEC/WESTECH of Phoenix, Ariz.

The polishing pad of the present invention will typically have a diameter of about 10–200 cm, preferably about 20–150 cm, more preferably about 25–100 cm. It may rotate as well, typically at a rate of about 5–10,000 rpm, preferably at a rate of about 10–1000 rpm, and more preferably about 10–250 rpm.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

EXAMPLES

Example 1

Pad Stack Allowing for Reuse of the Foam Layer

A fixed abrasive Pad Stack A is constructed as follows: A layer of pressure sensitive transfer adhesive (442DL, available from Minnesota Mining and Manufacturing Company (3M), St. Paul, Minn,) is laminated to each side of about a 0.09 inch thick piece of closed cell polyethylene foam (Volara Type 11EO, available from Voltek, division of Sekisui America Corp., Lawrence, Mass.). To one of the adhesive surfaces is laminated a silicone coated polyester release liner (2MIL CL PET 79B, available from Rexam, West Chicago, Ill.) such that the silicone coated side of the polyester liner is on the side facing away from the foam layer. Another layer of transfer adhesive (442DL, available from 3M, St. Paul, Minn.) is laminated to the silicone coated side of the release liner, and a piece of about 0.02 inch thick polycarbonate (Lexan 8010MC, available from General Electric Co., Schenectady, N.Y.) is laminated to this adhesive surface. Another layer of transfer adhesive (9671LE, available from 3M, St. Paul, Minn.) is laminated to the exposed polycarbonate surface, and a piece of microstructured fixed abrasive (3M Slurry Free CMP M2100, available from 3M, St. Paul, Minn.) is laminated to this adhesive surface, such that the microstructured fixed abrasive surface is exposed as the top layer. The entire pad stack is then die cut into about a 22.5 inch diameter round pad that fits onto the platen of a chemical mechanical polishing tool.

A fixed abrasive Replacement Pad Stack B is constructed as follows: A layer of transfer adhesive (442DL, available from 3M, St. Paul, Minn.) is laminated to a piece of about 0.02 inch thick polycarbonate (Lexan 8010MC, available from General Electric Co., Schenectady, N.Y.). Another layer of transfer adhesive (9671LE, available from 3M, St. Paul, Minn.) is laminated to the exposed polycarbonate surface, and a piece of microstructured fixed abrasive (3M Slurry Free CMP M2100, available from 3M, St. Paul, Minn.) is laminated to this adhesive surface, such that the microstructured fixed abrasive surface is exposed as the top layer. The entire pad stack is then die cut into about a 22.5 inch diameter round pad that fits onto the platen of a chemical mechanical polishing tool.

This composite Pad Stack A is bonded to the platen of a Westech 372 chemical mechanical polishing machine, and semiconductor wafers are polished until the fixed abrasive is substantially worn. The fixed abrasive/polycarbonate layers are easily removed from the silicone release liner/foam layers which remain adhered to the polishing platen with the silicone-coated polyester surface exposed, and the fixed abrasive/polycarbonate layers are discarded. Replacement Pad Stack B is placed on the exposed silicone-coated polyester surface remaining from Pad Stack A and pressed down with gentle hand pressure. More semiconductor wafers are then polished until the fixed abrasive of the Replacement Pad Stack B is substantially worn. The Replacement Pad Stack B is then removed from the silicone release liner/foam layers which remain adhered to the polishing platen with the silicone-coated polyester surface exposed, and the Replacement Pad Stack B is discarded. A new Replacement Pad Stack B is then placed on the exposed silicone-coated polyester surface remaining from Pad Stack A and pressed down with gentle hand pressure, and the process of polishing wafers and replacing the fixed abrasive pad is repeated.

What is claimed is:

1. A multi-layered polishing pad for polishing semiconductor wafers comprising:

a polishing layer;

at least one sub-pad layer adjacent the polishing layer; and an attachment layer interposed between and releasably joining the polishing layer and at least a portion of the at least one sub-pad layers, wherein the attachment layer comprises at least one layer selected from the group consisting of:

a low adhesion backsize material;

a release liner;

a stretch releasable adhesive;

a mechanical attachment device; and combinations thereof.

2. The multi-layered polishing pad of claim 1, wherein the at least one sub-pad layer comprises at least one resilient layer.

3. The multi-layered polishing pad of claim 1, wherein the at least one sub-pad layer comprises at least one rigid layer.

4. The multi-layered polishing pad of claim 1, wherein the at least one sub-pad layer comprises at least one layer having both resilient and rigid characteristics.

5. The multi-layered polishing pad of claim 1, wherein the at least one sub-pad layer comprises a plurality of sub-pad layers.

6. The multi-layered polishing pad of claim 5, wherein the attachment layer is interposed between the polishing layer and the plurality of sub-pad layers.

7. The multi-layered polishing pad of claim 5, wherein the attachment layer is interposed between at least one sub-pad layer and an adjacent sub-pad layer.

8. The multi-layered polishing pad of claim 5, further comprising a plurality of attachment layers.

9. The multi-layered polishing pad of claim 8, wherein at least one of the plurality of attachment layers is interposed between the polishing layer and the plurality of sub-pad layers, and at least one other of tile plurality of attachment layers is interposed between at least one sub-pad layer and an adjacent sub-pad layer.

10. The multi-layered polishing pad of claim 8, wherein at least one of the plurality of attachment layers is interposed between the polishing layer and the plurality of sub-pad layers, and at least one other of the plurality of attachment layers is interposed between the plurality of sub-pad layers and a polishing device to which the polishing pad is attached during a polishing process.

11. The multi-layered polishing pad of claim 8, wherein at least one of the plurality of attachment layers is interposed between at least one sub-pad layer and an adjacent sub-pad layer, and at least one other of the plurality of attachment layers is interposed between at least one other sub-pad layer and an adjacent sub-pad layer.

12. The multi-layered polishing pad of claim 8, wherein at least one of the plurality of attachment layers is interposed between at least one sub-pad layer and an adjacent sub-pad layer, and at least one other of the plurality of attachment layers is interposed between the plurality of sub-pad layers and a polishing device to which the polishing pad is attached during a polishing process.

13. The multi-layered polishing pad of claim 8, wherein at least one of the plurality of attachment layers is interposed between the polishing layer and the plurality of sub-pad layers, at least one other of the plurality of attachment layers is interposed between at least one sub-pad layer and an adjacent sub-pad layer, and at least one of yet another of the plurality of attachment layers is interposed between the plurality of sub-pad layers and a polishing device to which the polishing pad is attached during a polishing process.

14. The multi-layered polishing pad of claim 1, wherein the polishing layer comprises a three-dimensional textured fixed abrasive layer.

15. The multi-layered polishing pad of claim 14, wherein the fixed abrasive layer comprises an abrasive coating having a plurality of abrasive particles dispersed in a binder disposed on a backing.

16. The multi-layered polishing pad of claim 1, wherein the polishing layer comprises a surface configured for use in a slurry polishing process.

17. The multi-layered polishing pad of claim 1, wherein the at least one attachment layer comprises a pressure sensitive adhesive and a release liner.

18. The multi-layered polishing pad of claim 1, wherein the at least one attachment layer comprises a mechanical attachment device, wherein the mechanical attachment device comprises a hook and loop system.

19. The multi-layered polishing pad of claim 1, wherein the attachment layer comprises a stretch releasable adhesive.

20. The multi-layered polishing pad of claim 1, wherein the attachment layer comprises a plurality of layers configured for releasable attachment.

21. A multi-layered polishing pad capable of substantially conforming to a workpiece surface global topography while not substantially conforming to a workpiece surface local topography during surface modification of the workpiece using a polishing device, the multi-layered polishing pad comprising:

a three-dimensional, textured, fixed abrasive layer;

a sub-pad including at least one resilient layer and at least one rigid layer generally coextensive with the resilient layer, the rigid layer interposed between the resilient layer and the abrasive layer; and at least one attachment layer interposed between the abrasive layer and the resilient layer, wherein the attachment layer releasably joins the abrasive layer to at least a portion of the sub-pad, wherein the attachment layer comprises at least one layer selected from the group consisting of:
a low adhesion backsize material;
a release liner;
a stretch releasable adhesive;
a mechanical attachment device; and
combinations thereof.

22. The multi-layered polishing pad of claim 21, wherein the attachment layer is interposed between the abrasive layer and the sub-pad.

23. The multi-layered polishing pad of claim 21, wherein the attachment layer is interposed between the rigid layer and the resilient layer.

24. The multi-layered polishing pad of claim 21, wherein the attachment layer comprises a plurality of attachment layers.

25. The multi-layered polishing pad of claim 24, wherein at least one of the plurality of attachment layers is interposed between the abrasive layer and the sub-pad, and at least one other of the plurality of attachment layers is interposed between the rigid and resilient layers.

26. The multi-layer polishing pad of claim 21, wherein the fixed abrasive layer comprises an abrasive coating having a plurality of abrasive particles dispersed in a binder disposed on a backing.

27. The multi-layer polishing pad of claim 21, wherein the rigid layer includes the backing of the fixed abrasive layer.

28. The multi-layer polishing pad of claim 21, wherein the attachment layer comprises a pressure sensitive adhesive and a release liner.

29. The multi-layer polishing pad of claim 21, wherein the attachment layer comprises a mechanical attachment device, wherein the mechanical attachment device comprises a hook and loop system.

30. The multi-layer polishing pad of claim 21, wherein the attachment layer comprises a stretch releasably adhesive.

31. The multi-layered polishing pad of claim 21, wherein the resilient layer comprises one or more layers of a foam.

32. A method of modifying an exposed surface of a semiconductor wafer, comprising the steps of:

contacting the surface with a multi-layered polishing pad comprising:
a polishing layer;
at least one sub-pad layer adjacent the polishing layer; and
an attachment layer interposed between and releasably joining the polishing layer and at least a portion of the at least one sub-pad layer, wherein the attachment layer comprises at least one layer selected from the group consisting of:
a low adhesion backsize material;
a release liner;
a stretch releasable adhesive;
a mechanical attachment device; and
combinations thereof; and relatively moving the wafer and the multi-layered polishing pad thereby modifying the surface of the wafer.

33. A method of modifying an exposed surface of a semiconductor wafer, comprising the steps of:

contacting the surface with a multi-layered polishing pad comprising:
a three-dimensional, textured, fixed abrasive layer;
a sub-pad including at least one resilient layer and at least one rigid layer generally coextensive with the resilient layer, the rigid layer interposed between the resilient layer and the abrasive layer; and
at least one attachment layer interposed between the abrasive layer and the resilient layer, wherein the attachment layer releasably joins the abrasive layer to at least a portion of the sub-pad, and wherein the attachment layer comprises at least one layer selected from the group consisting of:
a low adhesion backsize material;
a release liner;
a stretch releasable adhesive;
a mechanical attachment device; and
combinations thereof; and relatively moving the wafer and the multi-layered polishing pad thereby modifying the surface of the wafer.

34. A method of replacing a polishing surface of a multi-layered polishing pad used with a polishing device for modifying the exposed surface of a semiconductor wafer, the method comprising the steps of:

providing a multi-layered polishing pad for attachment to a polishing device, the polishing pad comprising:
a polishing layer having a polishing surface for contacting a semiconductor wafer during a polishing process;
at least one sub-pad layer adjacent the polishing layer; and
an attachment layer interposed between and releasably joining the polishing layer and at least a portion of the at least one sub-pad layer, wherein the attachment layer comprises at least one layer selected from the group consisting of:
a low adhesion backsize material;
a release liner;
a stretch releasable adhesive;
a mechanical attachment device; and
combinations thereof;

removing the polishing layer of the multi-layered polishing pad when the polishing surface becomes unusable by detaching the polishing layer from the at least one sub-pad layer at the attachment layer and leaving at least a portion of the at least one sub-pad layer attached to the polishing device; and attaching another polishing layer having a usable polishing surface to the portion of the sub-pad layer attached to the polishing device.

* * * * *

UNITED STATES PATENT AND TRADEMARK OFFICE

CERTIFICATE OF CORRECTION

PATENT NO. : 6,746,311 B1
DATED : June 8, 2004
INVENTOR(S) : Kessel, Carl R.

It is certified that error appears in the above-identified patent and that said Letters Patent is hereby corrected as shown below:

Column 5,
Line 46, delete “the: platen” and insert in place thereof -- the platen --.

Column 6,
Line 30, delete “nonpatte med” and insert in place thereof -- nonpatterned --.

Column 7,
Line 60, delete the word “layers” and insert in place thereof -- layer --.

Column 8,
Line 21, delete the word “tile” and insert in place thereof -- the --.
Line 53, delete “three-dimensional textured” and insert in place thereof -- three-dimensional, textured --.

Column 9,
Line 55, delete the word “releasably” and insert in place thereof -- releasable --.

Signed and Sealed this

Fourth Day of January, 2005

JON W. DUDAS
*Director of the United States Patent and Trademark Office*